United States Patent [19]

Finn

[11] Patent Number: 4,470,601

[45] Date of Patent: Sep. 11, 1984

[54] PUZZLE

[76] Inventor: Stanley J. Finn, 1889 Skyline Dr., Richmond Hts., Ohio 44143

[21] Appl. No.: 453,792

[22] Filed: Dec. 27, 1982

[51] Int. Cl.[3] ..... A63F 9/08

[52] U.S. Cl. ..... 273/153 S; 273/281

[58] Field of Search ..... 273/153 R, 153 S, 281

[56] References Cited

U.S. PATENT DOCUMENTS

| | | | |
|---|---|---|---|
| 616,765 | 12/1898 | Brann | 273/153 R |
| 1,349,456 | 8/1920 | Hlasko | 273/153 S |

FOREIGN PATENT DOCUMENTS

| | | | |
|---|---|---|---|
| 653661 | 12/1962 | Canada | 273/153 R |
| 2359407 | 6/1975 | Fed. Rep. of Germany | 273/153 R |
| 1946 | of 1900 | United Kingdom | 273/153 R |

*Primary Examiner*—Anton O. Oechsle

*Attorney, Agent, or Firm*—Watts, Hoffmann, Fisher & Heinke Co.

[57] ABSTRACT

A new puzzle is disclosed having a game board with a plurality of playing paths arranged in a grid pattern that connects a first location to a second location on the board. Certain portions of the playing paths are structurally keyed, such portions forming a contiguous, keyed playing path connecting the first location to the second location. A playing piece having a key structure cooperable with the structure of the keyed playing path is slideably secured to the game board. The player attempts to maneuver the playing piece from the first location to the second location and succeeds only if the piece is slid along the keyed playing path. The keyed playing path is not readily distinguishable from the other playing paths.

16 Claims, 10 Drawing Figures

PUZZLE

DESCRIPTION

CROSS REFERENCE TO RELATED APPLICATION

This patent application is related to a co-pending design patent application filed by applicant and identified by Ser. No. 452,869, filed Dec. 27, 1982.

TECHNICAL FIELD

The present invention relates to a game and is more particularly directed to a puzzle game having movable playing pieces that are maneuvered from one location to another on a game board.

BACKGROUND ART

Many forms of puzzle games have provided much amusement to people of all ages. A particular category of puzzles requires the maneuvering of a plurality of playing pieces to specific locations on a game board.

DISCLOSURE OF THE INVENTION

The present invention provides a new puzzle which requires the player to reposition each of a plurality of coded and keyed playing pieces from one location on the game board to another location on the game board by sliding each of the keyed playing pieces along a cooperably keyed playing path connecting such locations together.

The puzzle of the present invention includes a game board having a plurality of playing paths. Certain portions of the playing paths are keyed, with similarly keyed portions being connected and defining keyed playing paths. Certain of the keyed playing paths connect at least one location on the game board to at least another location on the game board. At least one playing piece having a key structure is provided. The key structure of the playing piece is cooperable with at least one of the keyed playing paths connecting the one location to the other location on the game board. The player attempts to reposition the playing piece from the one location to the other location on the game board by attempting to maneuver the playing piece through the playing paths and succeeds when the playing piece is moved along the cooperably keyed playing path connecting the locations together.

A feature of the present invention is the provision of a plurality of intersecting playing paths connecting two locations together on a game board. A keyed playing piece can be moved from the one specific location to another on the game board only by maneuvering it along a keyed playing path that is cooperably keyed to the playing piece. The cooperably keyed playing path is not readily distinguishable by the player from the plurality of other noncooperably keyed playing paths connecting such locations.

Another feature of the present invention is the provision of a plurality of differently keyed playing pieces that are to be maneuvered on the game board, the game board having a plurality of cooperably keyed playing paths connecting initial positions to finish positions.

Still another feature of the present invention is that the plurality of playing pieces and the plurality of starting and finishing locations for each on the game board are coded to allow a player to properly associate each playing piece with its respective locations.

Other features and advantages and a fuller understanding of the invention will be had from the following detailed description and the accompanying drawings.

BEST MODE FOR CARRYING OUT THE INVENTION

Figure 1:
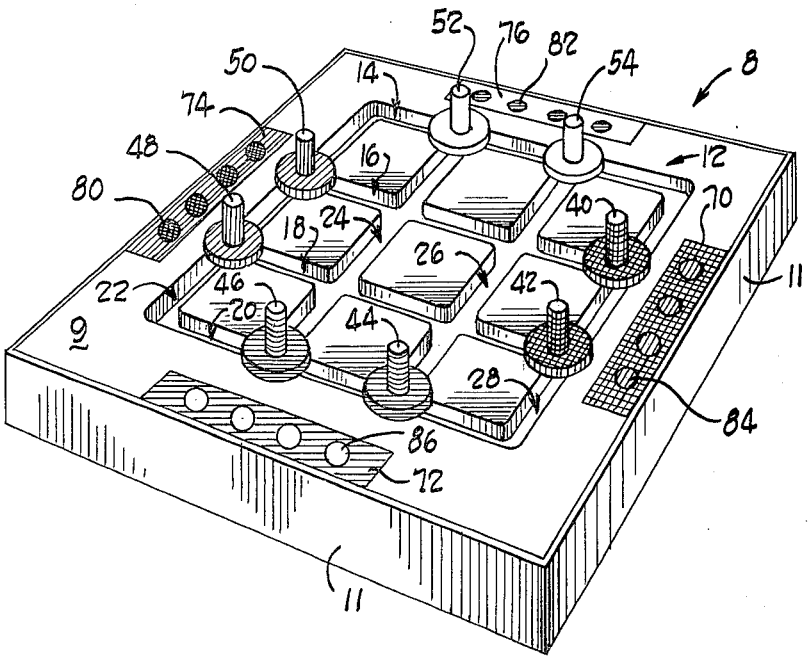
FIG. 1 is a perspective view of a game board employed in playing and solving the puzzle made in accordance with the present invention.

Referring now to the figures, there is shown a game board 8 used for playing and solving the puzzle of the present invention. The game board includes a top game playing surface 9, a bottom wall 10 spaced from the top game playing surface 9 and four side walls 11. A plurality of playing paths 12 are provided which are grooves in the top surface 9 of the game board 8. The grooves extend a predetermined depth toward the bottom wall 10 in a substantially perpendicular direction with respect to the top surface 9. The position, direction, shape and number of playing path grooves can vary from that specifically shown and described.

A four by four grid scheme is shown for purposes of explanation and clarity. Four playing paths 14, 16, 18, 20 are spaced apart and are substantially parallel with each other. Four other playing paths 22, 24, 26, 28, are spaced apart and are substantially parallel with each other. The playing paths 14 through 20 and the playing paths 22 through 28 are positioned to intersect at substantially right angles to each other with the overall scheme forming a grid of four by four intersecting playing paths.

A plurality of playing pieces 30 are located on the game board 8. Eight playing pieces are utilized on a four by four game board. The eight playing pieces are grouped in pairs of two to form four groups of playing pieces. Each of the groups of playing pieces are coded to identify them from the other groups of playing pieces. The coding of the playing pieces can take several forms, one of which is color coding. Playing pieces 40, 42 are colored yellow, playing pieces 44, 46 are colored brown, playing pieces 48, 50 are colored red and playing pieces 52, 54 are colored white. Coded game board indicia 60 on the game board 8 designate starting and finishing locations for playing and solving the puzzle.

Each location 60 includes a coded bar 62 and a series of coded dots 64. The coding of the bars 62 and the dots 64 also take the form of color coding. Bar 70 is yellow, bar 72 is brown, bar 74 is red and bar 76 is white. Dots 80 are yellow, dots 82 are brown, dots 84 are red and dots 86 are white.

A starting position for playing the puzzle is to have each color coded playing piece 30 positioned at one of the playing path intersections closest to the similarly matching color coded bar 62. Yellow pieces 40, 42 are therefore positioned at playing path intersections A and B respectively which are closest to the yellow bar 70. Brown pieces 44, 46 are positioned at the playing path intersections C and D respectively which are closest to the brown bar 72. Red pieces 48, 50 are positioned at the intersections E and F respectively which are closest to the red bar 74. White pieces 52, 54 are positioned at the intersections G and H closest to the white bar 76.

The object of the game is to maneuver and reposition the playing pieces on the game board to the playing path intersections closest to their matching color coded dots 64. Therefore, yellow pieces 40, 42 must be maneuvered, one each, to the playing path intersections E and F closest the matching dots 80 located directly opposite their initial starting position. Also, brown pieces 44, 46 must be maneuvered, one each, to the intersections G and H closest to the dots 82, red pieces 48, 50 must be maneuvered, one each, to the intersections A and B closest to the dots 84, and white pieces 52, 54 must be maneuvered, one each, to the intersections C and D closest to the dots 86. The finish position of the playing pieces for one game can be used as the starting position of the next game.

Figures 3A, 3B, 3C:
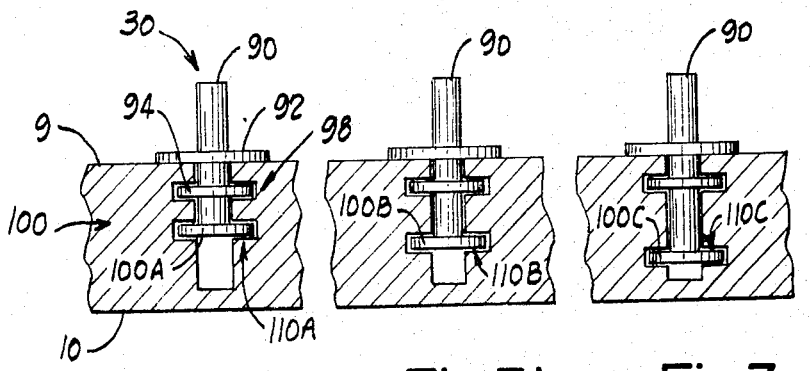
FIGS. 3*a* through 3*c* are partial cross-sectional fragmentary views of the game board showing various keyed playing pieces and cooperably keyed playing paths.

Referring now specifically to FIGS. 3*a* through 3*c*, each playing piece 30 includes a main body portion 90, a disc 92 and a disc shaped retaining member 94. The plane of the disc shaped retaining member 94 is substantially perpendicular to the main body portion 90. The main body portion 90 of each playing piece is dimensioned to fit within any of the playing path grooves on the game board. The disc 92 rests on the top surface 9 of the game board 8. Each of the playing path grooves 14 through 20 and 22 through 28 have a retaining channel 98 the entire length of the grooves and extending in a substantially perpendicular direction with respect to the walls of the playing path grooves and substantially parallel with the game board top surface 9. The retaining channel is cooperable with the retaining member 94 of each of the playing pieces 30. It will be appreciated that the retaining member 94 in cooperation with the retainer channel 98 slidably secure each of the playing pieces 30 to the game board 8.

Each of the playing pieces 30 has a key structure member 100 secured to the main body portion 90. Figures 3*a* through 3*c* show three different disc shaped key structures 100*a*, 100*b* and 100*c*. Each of the eight playing pieces has one of the three key structures. The plane of each of the disc shaped key structures 100*a*, 100*b* and 100*c* is substantially perpendicular to the main body portion 90. Each of the three key structures is a different distance from the retainer member 94. Certain portions of the playing paths 14 through 20 and 22 through 28 have cooperable key channels 110*a*, 110*b* and ll0*c* positioned to respectively accommodate one of the different key structures 100*a*, 100*b* and 100*c*. Some portions of the playing paths may have more than one of the key channels and yet other portions may have no key channels. It will be appreciated, for example, that a playing piece having a key structure 100*a* will be able to slide along a portion of a playing path having a cooperably keyed channel 110*a*. Similarly keyed portions of playing paths are contiguous to define a keyed playing path for a cooperably keyed playing piece.

Figure 4C:
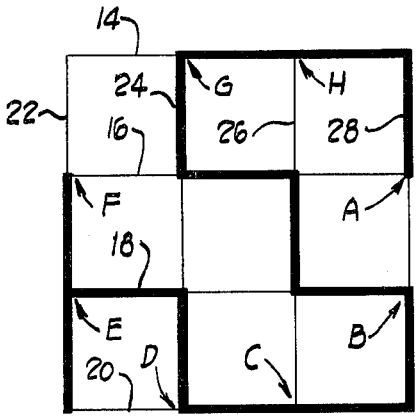
FIGS. 4*a* through 4*c* are a diagramatical representation of similarly keyed portions of playing paths connecting specific locations on the game board.
Figure 4B:
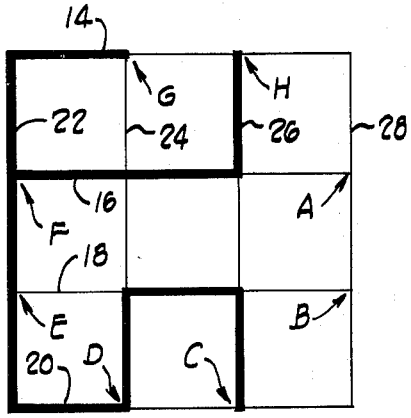
Figure 4A:
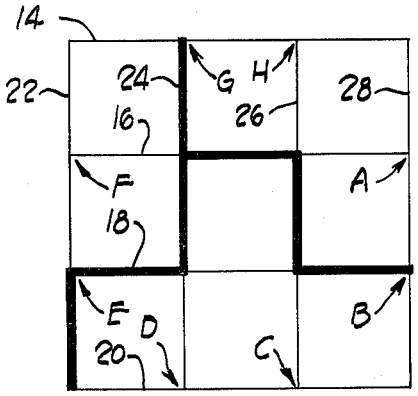

Referring now to FIGS. 4*a* through 4*c*, the permissable motion of the playing pieces will be better appreciated by considering a particular arrangement of keyed playing paths. The horizontal lines represent the playing paths 14 through 20 and the vertical lines represent the playing paths 22 through 28 which forms a four by four playing grid. The heavy darkened lines in FIG. 4*a* represent those portions of playing paths having key channels 110*a* that permit slideable movement of a playing piece having a keyed structure 100*a* shown in FIG. 3*a*. The heavy darkened lines in FIG. 4*b* show those portions of the playing paths having key channels 110*b* that permit slidable motion of a playing piece having a keyed structure 100*b* shown in FIG. 3*b*. The heavy darkened portions shown in FIG. 4*c* show those portions of the playing paths having key channels 100*c* that permit sliding motion of a playing piece having the key structure shown in FIG. 3*c*. It should be noted that certain portions of playing paths have more than one key channel which means that more than one keyed playing piece can maneuver through that portion. Also, some portions of playing paths have no key channels which prevents any keyed playing piece from maneuvering through that portion.

Figure 5:
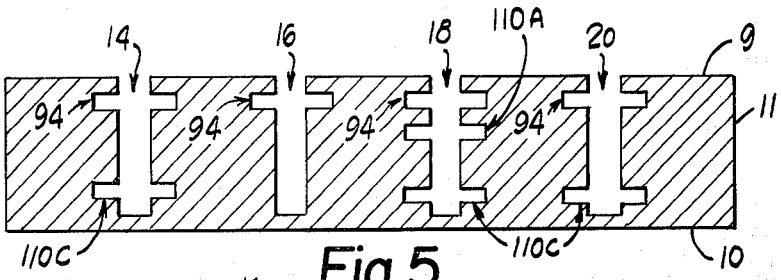
FIG. 5 is a side sectional view taken along line 5—5 of FIG. 2, certain parts being omitted for clarity.
Figure 6:
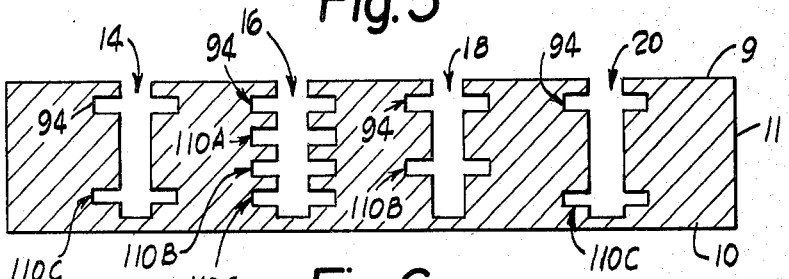
FIG. 6 is a side sectional view taken along line 6—6 of FIG. 2, certain parts being omitted for clarity.

Referring now to FIG. 5, the keyed playing paths will be better understood. By taking a cross-sectional view along line 5—5 of FIG. 2 and referring to the keyed playing paths shown in FIGS. 4*a* through 4*c*, it will be readily apparent that the key structure of a portion of the playing path 14 between playing paths 26 and 28 will be cooperable only with a playing piece having a key structure 100*c* as shown in FIG. 3*c*. The portion of the playing path 16 between playing paths 26 and 28 has the retaining channel but no key channels, and therefore will not be cooperable with any of the keyed structures 100*a* through 100*b* shown in FIGS. 3*a* through 3*c*. Therefore, no playing piece can pass along the portion of playing path 16 between paths 26, 28. The portion of playing path 18 between paths 26 and 28 is cooperable with either a playing piece having a key structure 100*a* as shown in FIG. 3*a* or a playing piece having a key structure 100*c* as shown in FIG. 3*c*. The portion of the playing path 20 between paths 26 and 28 is cooperable only with a playing piece having a key structure 100*c* as shown in FIG. 3*c*.

Figure 2:
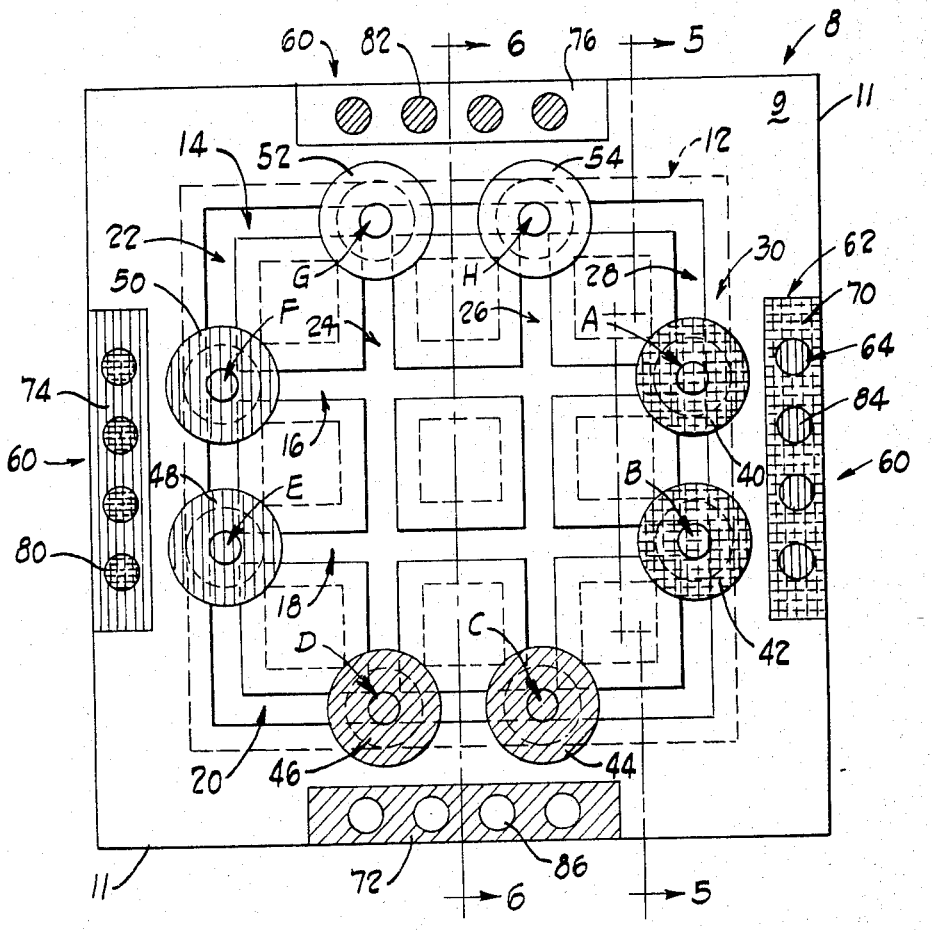
FIG. 2 is a top plan view of a game board employed in playing and solving the puzzle made in accordance with the present invention.

The playing paths along the cross-section of line 6–6 of FIG. 2 is next examined. The portion of playing path 14 between paths 24, 26 is cooperable with a playing piece having a key structure 100*c* shown in FIG. 3*c*. The portion of playing path 16 between paths 24, 26 has all the key channels and is therefore cooperable with any playing piece, having the key structure 100*a*, 100*b* or 100*c* as shown in FIGS. 3*a*, 3*b*, or 3*c*, respectively. The portion of playing path 18 between paths 24, 26 is cooperable only with a playing piece having a key structure 100*b* as shown in FIG. 3*b*. The portion of playing path 20 between paths 24, 26 is cooperable with a playing piece having a key structure 100*c* as shown in FIG. 3*c*.

The similarly keyed portions of the playing paths shown in FIGS. 4*a* through 4*c* are contiguous and define keyed playing paths. Three keyed playing paths are shown and three key structures of the playing pieces are shown. Each keyed playing piece can move only along a cooperably keyed playing path. Motion of a playing piece is blocked by a non-cooperably keyed portion of playing path. It will also be appreciated that one playing piece can block the travel of another playing piece. The diameter of the discs 92 and the spacing between playing paths are such that the playing pieces can block the passage of other playing pieces in an adjacent cross playing path. For example, if playing piece 52 is positioned in path 24 completely between paths 14 and 16, no other playing piece can be slid past player 52 in paths 14 or 16. To slide a piece in path 14 past player 52, the player 52 would have to be slid out of the way to permit clearance. The diameter of the discs are slightly less than the distance between adjacent playing paths.

Certain portions of playing paths are cooperably keyed to a playing piece but do not lead or connect to a desired location. Such paths permit a playing piece to be "moved out of the way" while allowing passage of another playing piece. Also, such paths add intrigue to the puzzle by permitting a player to move a playing piece in an improper direction.

One particular arrangement of keyed playing pieces in conjunction with the keyed playing paths shown in FIGS. 4*a* through 4*c* is that playing pieces 40 and 50 have key structures 100*c* as shown in FIG. 3*c*. Playing pieces 54, 44 have the key structure 100*b* as shown in FIG. 3*b*. The remaining playing pieces 52, 42, 46, and 48 have the key structure 100*a* as shown in FIG. 3*a*.

It will be appreciated that since the playing pieces can move only along cooperably keyed playing paths and because there are a plurality of players on the game board, maneuvering each of the playing pieces from one particular location to another location on the game board is difficult and makes solution of the puzzle challenging. It is even more perplexing to solve the puzzle because the keying structure of the playing paths depicted in FIGS. 4*a* through 4*c* are not easily visible to the player trying to solve the puzzle since the key channels and keyed structures of the playing piece are below the top surface 9 of the game board 8. The playing paths as viewed from the top surface 9 give an appearance of being the same. Also, the disc 92 partially obscures the view of the key structure of its playing piece. Furthermore, each playing piece having the same color coding has a different key structure and therefore must follow a different path from the starting positions to finish positions. This adds to the difficulty of the puzzle.

Once the puzzle has been solved by maneuvering the playing pieces to the proper location, it will be appreciated that the dual coding of these locations permits such location to become the starting points for another game. For example, if the solution of the game is to position the playing pieces by their similarly coded dots, the next game can be to maneuver them by their similarly coded bar. Also, any random positioning of the playing pieces on the board can be considered a starting position for a game with the solution to be the repositioning to another location.

It is contemplated that the game board can be manufactured by various methods. The preferred method is to have the entire game board built up in a plurality of layers with the dimensions of each of the layer pieces establishing the playing paths, the outside walls, the channels 110*a* through 110*c* and the retaining channels 94. Also, the board can be made by machining squares between the playing paths 14 through 20 and 22 through 28 and then securing the squares to the base of the game board. Outside walls would be machined and secured to the base with the outside wall and the squares defining the playing paths 14 through 20 and 22 through 28.

Other modifications and various features of the invention will be apparent to those skilled in the art in view of the foregoing detailed disclosure. For example, the invention has been described with reference to a four by four grid square of playing paths on a game board with eight playing pieces having three key structures and cooperably keyed paths. Any number of combinations and permutations are possible for the number of playing paths, number of playing pieces, or number of key structures. Also, the shape and direction of the playing paths can be varied. Furthermore, the number and arrangement of key structures and key channels can vary from that shown or described. It will also be appreciated that the key structures on the playing pieces in combination with the key channels in the playing paths would be sufficient to slidably secure the playing pieces to the game board. Therefore, it is to be understood that, within the scope of the appended claims, the invention can be practiced otherwise than as specifically shown and described.

I claim:

1. A game comprising:

a game board having a plurality of playing paths connecting a plurality of code designated locations on said game board, some of said playing paths intersecting others of said playing paths, certain portions of some of said playing paths having different key structures, similarly keyed portions of said playing paths being contiguous to define a plurality of keyed playing paths, each of said keyed playing paths connecting two code designated locations on said game board;

a plurality of playing pieces, each having a key structure and a code designation corresponding to at least one of the code designated locations on said game board, each playing piece key structure being cooperable with a keyed playing path connecting to its corresponding code designated location on said game board.

2. The game of claim 1 wherein each playing piece includes a retaining structure to slidably secure such playing piece to said game board.

3. The game of claim 1 wherein said game board includes a spaced apart top and bottom surface, said playing paths including a plurality of spaced apart walls extending substantially perpendicular from said top surface toward said bottom surface, the space between said walls defining the playing paths, portions of each of said playing path walls having channels extending from and substantially perpendicular to said walls, said channels defining said key structure of said playing paths.

4. The game of claim 3 wherein one of said different key structures of portions of said playing paths include at least one of said channels spaced a predetermined distance from said top surface of said game board, other of said key structures of portions of said playing paths including at least one of said channels spaced another predetermined distance from said top surface.

5. The game of claim 3 wherein some of said plurality of playing paths intersect others of said plurality of playing paths in a perpendicular manner and run adjacent to yet others of said plurality of playing paths in a parallel manner.

6. The game of claim 5 wherein each of said playing pieces includes a blocking structure having a dimension slightly less than the distance between adjacent parallel playing paths.

7. The game of claim 3 wherein said top surface of said game board at least partially obscures a view of said key structures of said plurality of said playing paths.

8. The game of claim 1 wherein each of said two code designated locations have a similar coding, at least one keyed playing path connecting such correspondingly similar code designated locations, a cooperably coded playing piece being movable therebetween through such at least one keyed playing path connecting such locations.

9. The game of claim 1 wherein each of said playing pieces has a structure fixed thereto to at least partially obscure a view of the key structure of its associated playing piece.

10. The game of claim 1 wherein each code designated location has two color codes, a corresponding two color coded location being positioned at another location on the game board.

11. The game of claim 10 wherein each code designated location is next to two adjacent playing path intersections, a keyed playing path connecting one playing path intersect to a playing path intersection for said corresponding color coded location.

12. The game of claim 11 wherein the keyed playing paths for adjacent intersections of one code designated location have different structures.

13. The game of claim 12 wherein two playing pieces have the same color coding as one color of a code designated location.

14. The game of claim 13 wherein each code designated location has a playing piece position at each of its playing path intersections, each two playing pieces of a code designated location being a different color than any other of said playing pieces.

15. A puzzle comprising:

a puzzle board having spaced apart top and bottom walls and four side walls;

a plurality of playing path grooves located in said top wall, said playing path grooves having spaced apart playing walls extending substantially perpendicular from said top wall toward said bottom wall, the space between said playing walls defining playing paths, said playing paths oriented in an intersecting grid pattern, some of said playing paths being parallel with other playing paths and perpendicular to yet other playing paths;

playing path key structures in communication with certain portions of said playing paths, said playing path key structures being channels extending from and substantially perpendicular to said playing walls, said channels being spaced a predetermined distance from said top wall, portions of said playing paths having channels positioned the same depth from said top wall being contiguous and defining a keyed playing path;

code designated first and second locations on said puzzle board, each first and second location having two similarly corresponding color codes and each being positioned near two adjacent playing path intersections on said puzzle board;

one keyed playing path each connecting one intersection near the first location to one intersection of the corresponding second location, the keyed playing paths for the two adjacent playing path intersections of the first and second location having a different key structure; and playing pieces slideably secured to said game board, one playing piece for each playing path intersection of said first and said second locations, said playing pieces having key structures cooperable with the keyed playing path connecting its associated intersection to the intersection at the corresponding other location on the puzzle board, said playing pieces being color coded to correspond to one of the colors of the first and second locations.

16. The puzzle of claim 15 wherein said playing paths form a four by four grid and said puzzle further comprises and third and a fourth code designated location on said puzzle board and eight playing pieces, the eight playing pieces being arranged in four pairs of playing pieces, one pair for each code designated location, each pair having a different color code, the four code designated locations arranged in pairs, each pair of code designated locations having two color codes, each pair of playing pieces corresponding to one color code of the code designated locations.

* * * * *